United States Patent [19]

Lorenz

[11] 4,451,716

[45] May 29, 1984

[54] ELASTIC-SPRING DRIVE FOR THE MOVABLE CONTACT OF AN ELECTRIC GROUNDING OR DISCONNECT SWITCH

[75] Inventor: Dieter Lorenz, Berlin, Fed. Rep. of Germany

[73] Assignee: Siemens Aktiengesellschaft, Munich, Fed. Rep. of Germany

[21] Appl. No.: 411,815

[22] Filed: Aug. 26, 1982

[30] Foreign Application Priority Data

Sep. 11, 1981 [DE] Fed. Rep. of Germany ..... 3136771

[51] Int. Cl.[3] ..... H01H 21/42

[52] U.S. Cl. ..... 200/67 A; 200/153 G; 74/97

[58] Field of Search ..... 200/67 R, 67 A, 153 SC; 74/97, 100 R

[56] References Cited

U.S. PATENT DOCUMENTS

| | | | |
|---|---|---|---|
| 935,226 | 9/1909 | Peterson | 200/67 A |
| 1,518,701 | 12/1924 | Penn | 200/67 A |
| 1,637,961 | 8/1927 | Wells | 200/67 A |
| 2,014,637 | 9/1935 | Schellenger | 200/67 A |
| 2,131,269 | 9/1938 | Byram | 200/67 A |
| 2,198,277 | 4/1940 | Schellenger | 200/67 A X |
| 3,538,273 | 11/1970 | Oster | 200/67 |
| 4,166,938 | 9/1979 | Peek | 200/153 G |

*Primary Examiner*—Stephen Marcus
*Assistant Examiner*—Ernest G. Cusick
*Attorney, Agent, or Firm*—Kenyon & Kenyon

[57] ABSTRACT

An elastic-spring drive for the movable contact of an electric grounding or disconnect switch is disclosed. The movable contact is coupled by at least one lever to a drive shaft. A drive lever is rigidly connected to the drive shaft and a cocking lever is rotatably coupled to the drive shaft. An elastic compression spring is supported flexibly at both ends between the drive lever and the cocking lever, one end of the spring being connected to the free end of the drive lever and the other end to the free end of the cocking lever. This arrangement enables the drive lever to be held stationary during cocking of the spring. The spring is slowly cocked by the motion of the cocking lever until it is fully compressed while the drive lever is stationary. Continued rotation of the cocking lever thereafter abruptly releases the spring which quickly rotates the drive lever to its end position, thereby rotating the drive shaft.

1 Claim, 1 Drawing Figure

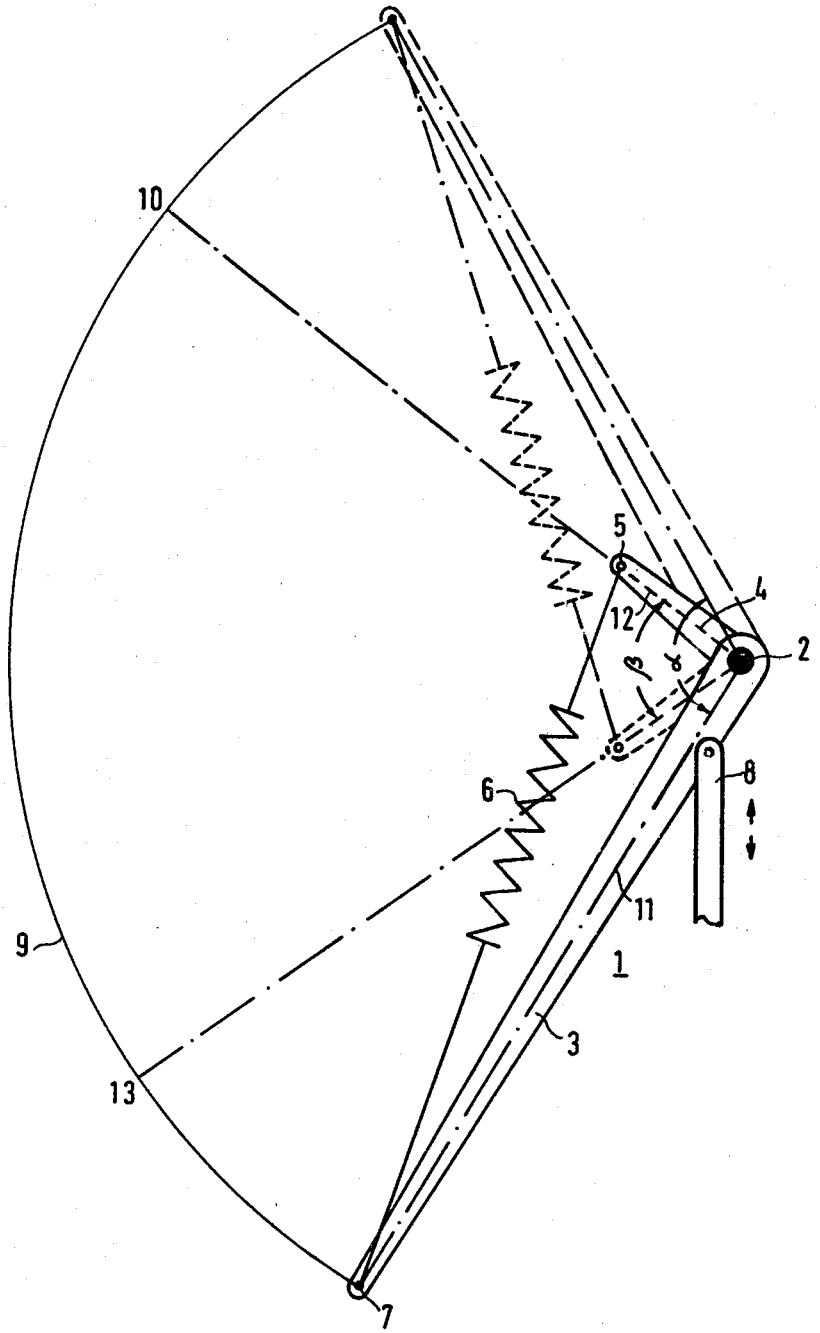
10
5
4
12
2
8
6
11
9
1
3
13
7

ELASTIC-SPRING DRIVE FOR THE MOVABLE CONTACT OF AN ELECTRIC GROUNDING OR DISCONNECT SWITCH

BACKGROUND OF THE INVENTION

The present invention relates to an elastic spring drive for the movable contact of an electric switch, particularly a grounding or disconnect switch.

DE-OS No. 28 39 424 discloses an elastic-spring drive for an electric switch in which one end of an elastic spring is held stationary and the other end is connected to a cocking lever which is rotatably supported on a drive shaft. An angle lever having arms of different length is rotatably supported by the drive shaft and a drive lever is rigidly connected to the drive shaft to rotate therewith. The cocking lever is of the double strap or forked type with the pin to which the spring is connected extending between the straps. On both sides of the cocking lever are disposed stops for the shorter arm of the angle lever and two pawls which act in both switching directions to take the drive lever along with the cocking lever after a delay.

To initiate switching in the switch disclosed in DE-OS No. 28 39 424, the actuating lever acts on the longer arm of the angle lever and rotates it until the shorter arm of the angle lever comes into contact with one stop of the cocking lever thereby moving the cocking lever after a delay in the direction of rotation of the angle lever. The elastic spring, which is released in the end positions of the switch, now begins to be compressed. After a further delay, one pawl of the cocking lever takes the drive lever along with it in the direction of rotation of the cocking lever which causes a corresponding rotation of the drive shaft, whereby the movable contact is slowly moved from its end position. After reaching a fully-compressed position, i.e., the position in which the longitudinal axes of the elastic spring and the drive lever coincide, the elastic spring is abruptly released and quickly and vigorously rotates the drive shaft via the drive lever into an end position thereof to switch the switch into its other switch position.

While in the elastic-spring drive described in DE-OS No. 28 39 424, a double delay is provided between rotation of the angle lever, which acts as a driver, and rotation of the drive lever which is rigidly connected to the drive shaft, a relatively slow motion of the contact occurs during compression of the elastic spring before the fully-compressed position of the spring is reached, which may be undesirable especially in view of the small insulation gaps provided in switches which are employed in compressed-gas-insulated encapsulated switching installations.

OBJECT AND SUMMARY OF THE INVENTION

It is an object of the present invention to provide an elastic-spring drive for an electric switch, particularly a grounding or disconnect switch of the general type described above, in which the movable contact does not move during cocking of the elastic spring.

This and other objects are achieved in accordance with the invention by providing an elastic spring drive for the movable contact of an electric switch having a drive shaft to which the movable contact of the switch is connected by at least one lever, the drive comprising a drive lever rigidly connected to the drive shaft, a cocking lever rotatably coupled to the drive shaft, an elastic spring connected as a compression spring at one end to the cocking lever and at the other end to the drive lever, and an actuating lever engaging the cocking lever to rotate the cocking lever upon movement of the actuating lever.

The above arrangement according to the invention simplifies the structure of the elastic-spring drive since, except for the lever(s) connected to the movable contact, only the cocking lever and the drive lever are supported, rotatably and rigidly, respectively, by the drive shaft. The elastic spring is flexibly, e.g. pivotally, connected between the free ends or sides of the cocking lever and the drive lever which face away from the drive shaft, and is released from compression in the respective end positions of the movable contact.

For initiating switching motion, the actuating lever is moved in the direction of its longitudinal axis and acts directly on the cocking lever to rotate it relative to the drive lever about the drive shaft. Thereby, the elastic spring is compressed by the cocking lever until it is in its fully-compressed position. The drive lever is then in one of its two end positions and is held firmly in that one end position by the compression force of the spring. After passing the fully-compressed position, the spring is abruptly released and thereby rotates the drive lever and moves the drive lever in a direction opposed to the direction of motion of the cocking lever into its other end position, whereby the movable contact is quickly transferred into its other end position by the corresponding rotation of the drive shaft. Thus, the drive lever remains in a rest position during the entire spring compressing process and correspondingly, the movable contact remains in its end position. Switching speed during movement of the drive lever due to the release of the spring is high, since more time is available for acceleration. Thereby, a desired fast switching action is obtained.

The above and other objects, features, aspects and advantages of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the sole FIGURE of the accompanying drawing which is a side schematic view of an elastic switch drive according to the invention.

DESCRIPTION OF THE PREFERRED EMBODIMENTS

An elastic-spring drive 1 according to the invention comprises a cocking lever 3 rotatably supported by a drive shaft 2 and a drive lever 4 rigidly connected to the drive shaft 2. The free end 5 of the drive lever 4 (facing away from the drive shaft 2) is pivotally connected to one end of an elastic compression spring 6. The other end of the spring is pivotally connected to the free end 7 of the cocking lever 3 (facing away from the drive shaft 2). The cocking lever 3 is connected to an actuating lever 8 which is movable in the direction of its longitudinal axis as indicated by arrows.

The solid lines in the drawing depict the elasticspring drive 1 in an end position of the movable contact, not shown, of a grounding or disconnect switch. The movable contact is driven by levers, not shown, coupled to the drive shaft 2. Moving the actuating lever 8 upwardly in the direction of the upwardly pointing arrow moves the end 7 of the cocking lever 3 clockwise along the circular arc 9, the elastic spring 6 being compressed during this movement. Upon reaching the fully-compressed position of the spring at 10, in which the direction of the longitudinal axis 11, indicated in the drawing by the dash-dotted line, of the cocking lever 3 and the longitudinal axis 12, indicated in the drawing by the dashed line, of the drive lever 4, coincide, the maximum compression of the elastic spring 6, and thus the maximum spring force, can be obtained. After the fully-compressed spring position 10 is passed, the elastic spring 6 is abruptly released and thereby moves the drive lever 4 in a counterclockwise direction opposite to the direction of motion of the cocking lever 3 into its second end position, indicated by dashed lines in the drawing. The cocking lever 3 also travels into its end position, indicated by dashed lines in the drawings.

The drive lever 4 is thereby held in its respective end position during cocking of the resilient spring 6 as the spring force is increased, and is released for fast movement in a direction opposite to the direction of the motion of the cocking lever 3 when the elastic spring 6 is released after passing the fully-compressed spring position 10 when the maximum spring force of the elastic-spring drive 1 is realized. Corresponding to the fast motion of the drive lever 4 from one end position to the other end position over the angle $\beta$, the drive shaft 2 is quickly rotated and accordingly, the movable contact of the switch is quickly moved from one switch position into the other switch position.

By moving the actuating lever 8 in the opposite (downwardly) direction, the cocking lever 3 returns slowly into the end position indicated by solid lines from the end position indicated in dashed lines, travelling over the angle $\alpha$, the fast rotary motion of the drive lever 4 in the counterclockwise direction is released only after the fully compressed spring position 13 is passed.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purpose of disclosure without departing from the spirit from the spirit and scope of the invention.

What is claimed is:

1. An elastic-spring drive for a movable contact of an electric switch comprising a drive shaft adapted to be coupled to the movable contact of the switch by at least one lever, a drive lever rigidly connected to the drive shaft, a cocking lever rotatably connected to the drive shaft, a spring flexibly connected at one end to the cocking lever at a first distance from the axis of the drive shaft and flexibly connected at the other end to the drive lever at a second distance from the axis of the drive shaft, said first distance being greater than said second distance, and an actuating lever coupled to the cocking lever to rotate the cocking lever upon movement of the actuating lever.

* * * * *